US012158324B2

(12) United States Patent
Schulte et al.

(10) Patent No.: US 12,158,324 B2
(45) **Date of Patent: *Dec. 3, 2024**

(54) WEAPON SIGHT WITH TAPERED HOUSING

(71) Applicant: EOTech, LLC, Plymouth, MI (US)

(72) Inventors: Mark Edwin Schulte, Manchester, MI (US); Anthony Heath, Ypsilanti, MI (US)

(73) Assignee: EOTech, LLC, Plymouth, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/046,234

(22) Filed: Oct. 13, 2022

(65) Prior Publication Data

US 2023/0054268 A1 Feb. 23, 2023

Related U.S. Application Data

(63) Continuation of application No. 16/690,706, filed on Nov. 21, 2019, now Pat. No. 11,486,675.

(51) Int. Cl.
*F41G 1/30* (2006.01)
*F41G 1/16* (2006.01)

(52) U.S. Cl.
CPC ..... *F41G 1/16* (2013.01)

(58) Field of Classification Search
CPC ..... F41G 1/16; F41G 1/30; F41G 1/06; G02B 5/32; G02B 23/10; G03H 1/22
(Continued)

(56) References Cited

U.S. PATENT DOCUMENTS 198,415 A 12/1877 Ramsey
1,984,115 A 12/1877 Ramsey
(Continued)

FOREIGN PATENT DOCUMENTS

CN 305189285 5/2019
CN 305671269 3/2020
(Continued)

OTHER PUBLICATIONS

MidTen 1X22X33, first available: Sep. 11, 2018 [site visited: Aug. 11, 2021] URL: https://www.aniazon.corn/ MidTen-IX22X32-Reticles-Refiex-Detachldp/B07H8VRFX0/ (Year:2018).
(Continued)

*Primary Examiner* — Michael D David
(74) *Attorney, Agent, or Firm* — Bodman PLC

(57) ABSTRACT

Methods and systems are disclosed for a weapon sight with a tapered housing. The housing may be configured to enclose an optical bench and/or a portion of an adjuster assembly within the weapon sight. The housing may include an outer shell, a first window, and a second window. The first window may define a first area. The second window may define a second area. The second area may be greater than the first area, for example, such that the outer shell is tapered outward from the first opening to the second opening. The outer shell may define a first wall and a second wall that extend between the first opening and the second opening on opposed sides of an optical path of the weapon sight. The first wall and the second wall may be slanted outward from the first window to the second window.

18 Claims, 21 Drawing Sheets

(58) Field of Classification Search
USPC ..... 42/111, 118, 130, 131, 135, 136, 137
See application file for complete search history.

(56) References Cited

U.S. PATENT DOCUMENTS

| | | | | |
|---|---|---|---|---|
| 237,884 | A | 2/1881 | Singer et al. | |
| 277,600 | A | 5/1883 | Mooers et al. | |
| 5,564,211 | A * | 10/1996 | Mossberg | F41A 17/08 42/70.11 |
| 7,721,481 | B2 | 5/2010 | Houde-Walter | |
| D662,566 | S | 6/2012 | Estes | |
| 9,423,212 | B2 * | 8/2016 | Campean | F41G 1/345 |
| 9,453,706 | B1 | 9/2016 | Crispin | |
| 9,752,853 | B2 | 9/2017 | Teetzel | |
| 10,175,029 | B2 | 1/2019 | Teetzel | |
| D847,292 | S | 4/2019 | Hoff | |
| 10,247,515 | B2 | 4/2019 | Collin | |
| D872,219 | S | 1/2020 | Horton | |
| 10,563,955 | B2 | 2/2020 | Pniel | |
| 10,605,565 | B1 | 3/2020 | Geissele | |
| 10,704,862 | B2 | 7/2020 | Chung | |
| D895,760 | S | 9/2020 | Johnston | |
| D906,465 | S | 12/2020 | Horton | |
| 10,921,091 | B2 | 2/2021 | Borrico | |
| 10,942,005 | B2 | 3/2021 | Teetzel | |
| 2006/0164704 | A1 | 7/2006 | Sieczka | |
| 2011/0063102 | A1 * | 3/2011 | Ivtsenkov | F41A 17/08 340/505 |
| 2011/0228366 | A1 | 9/2011 | Liu | |
| 2013/0263491 | A1 | 10/2013 | Jung et al. | |
| 2014/0109457 | A1 | 4/2014 | Speroni | |
| 2014/0130395 | A1 | 5/2014 | Scroggins | |
| 2014/0237884 | A1 | 8/2014 | Koesler | |
| 2014/0268323 | A1 | 9/2014 | Feinberg | |
| 2014/0283431 | A1 | 9/2014 | Tuller, Jr. | |
| 2014/0305022 | A1 | 10/2014 | Chung | |
| 2014/0334058 | A1 | 11/2014 | Galvan | |
| 2015/0198415 | A1 | 7/2015 | Campean | |
| 2016/0169605 | A1 * | 6/2016 | Courtot | F41A 17/46 42/70.06 |
| 2016/0313089 | A1 | 10/2016 | Collin | |
| 2017/0341257 | A1 | 11/2017 | Teetzel | |
| 2019/0277600 | A1 | 9/2019 | Larsson | |
| 2020/0025518 | A1 | 1/2020 | Nackel | |
| 2020/0033096 | A1 | 1/2020 | Sabaldan Elpedes | |
| 2021/0156645 | A1 | 5/2021 | Heath | |
| 2021/0156646 | A1 * | 5/2021 | Schulte | F41G 1/16 |
| 2021/0157086 | A1 | 5/2021 | Heath | |
| 2021/0157119 | A1 | 5/2021 | Heath | |
| 2021/0157267 | A1 | 5/2021 | Heath | |
| 2021/0207928 | A1 | 7/2021 | Brewer | |

FOREIGN PATENT DOCUMENTS

| | | | |
|---|---|---|---|
| EP | 0315379 | A2 | 5/1989 |
| GB | 541887 | A | 12/1941 |
| KR | 300743516 | | 5/2014 |
| KR | 3007435160000 | | 5/2014 |
| KR | 20150001056 | U | 3/2015 |
| WO | 2008153741 | A1 | 12/2008 |

OTHER PUBLICATIONS

Holosun HS510C, first available: Aug. 6, 2019, [site visited Aug. 11, 292111.AL: https./w.amazon.com/HOLOSUN-H5510C-Lithium-Eatteries-Oleaningidp/B07W6HSV1Li (Year: 2019).

International Search Report & Written Opinion for application No. POTILIS2020/060702 dated Jun. 22, 2021, 12 pp.

J.S. Design U.S. Appl. No. 29/714,253, flied Nov. 21, 2019.

Holosun HS510C, first available: Aug. 6, 2019, [site visited Aug. 11, 2021] URL: https://www.amazon.com/HOLOSUN-HS510C-Lithium-Batteries-Cleaning/dp/B07W6HSV1L/ (Year: 2019).

International Search Report for Application No. PCT/US2020/060702; dated Jun. 22, 2021; 2 pp.

MidTen 1X22X33, first available: Sep. 11, 2018 [site visited: Aug. 11, 2021] URL: https://www.amazon.com/MidTen-1X22X32-Reticles-Reflex-Detach/dp/B07H8VRFXC/ (Year:2018).

Design U.S. Appl. No. 29/714,253, filed Nov. 21, 2019.

* cited by examiner

100

100

100

WEAPON SIGHT WITH TAPERED HOUSING

CROSS-REFERENCE TO RELATED APPLICATION(S)

This application is a continuation of U.S. patent application Ser. No. 16/690,706, filed Nov. 21, 2019, the entire disclosure of which is incorporated by reference herein.

BACKGROUND

Identifying and focusing on an object located at a distance may be facilitated by use of a sight. A sight may be employed, for example, with small arms such as bows, rifles, shotguns, and handguns, etc. and large arms such as mounted machine guns, grenade launchers, etc., and may assist an operator to locate and maintain focus on a target.

Sights have been developed in many different forms and utilizing various features. For example, sights have been developed that present the operator with a hologram which may assist the operator with locating and focusing on an object.

SUMMARY OF THE INVENTION

Methods and systems are disclosed for a weapon sight with a tapered housing. A weapon sight may include a base, an optical bench, an adjuster assembly, and/or a housing. The base may be configured to be releasably secured to a weapon. The optical bench may be configured to be attached to the base. The optical bench may include a plurality of optical elements attached to a unibody chassis. The weapon sight may be a holographic weapon sight. The plurality of optical elements may include a laser diode, a mirror, a collimating optic, and/or a diffractive grating. The laser diode may be configured to reconstruct a holographic reticle. The adjuster assembly may be configured to be attached to the base. The adjuster assembly may include a first adjuster configured to horizontally adjust a position of the holographic reticle. The adjuster assembly may include a second adjuster configured to vertically adjust the position of the holographic reticle.

The housing may be configured to enclose the optical bench and/or a portion of the adjuster assembly within the weapon sight. The housing may include an outer shell, a first window, and a second window. The first window may be a rear window that faces a user of the weapon sight. The second window may be a front window that faces a target. The outer shell may define a first opening and a second opening. The first window may be located at the first opening and the second window may be located at the second opening. The first window may define a first area. The second window may define a second area. The second area may be greater than the first area, for example, such that the outer shell is tapered outward from the first opening to the second opening. The outer shell may be tapered at an angle that is determined based on a distance from a user's eye to the first window and a horizontal field of view for the weapon sight. The outer shell may be tapered such that an obscured portion of the horizontal field of view (e.g., obscured by the housing) is below a predetermined threshold for the horizontal field of view.

The outer shell may define a first wall and a second wall that extend between the first opening and the second opening on opposed sides of an optical path of the weapon sight. The first wall and the second wall may be slanted outward from the first window to the second window. The first wall may be a first distance D1 from the second wall at the first opening. The first wall may be a second distance D2 from the second wall at the second opening. D2 may be greater than D1. The first area may be configured based on D1. The second area may be configured based on D2.

The outer shell may include a first adjuster hole that receives a portion of the adjuster assembly. The outer shell may define a recess that receives an outer surface of the optical bench. The outer shell may include a lower portion and an upper portion. The lower portion may be configured to enclose a power source, the adjuster assembly, and/or a portion of the optical bench. The upper portion may include the first adjuster hole. The upper portion may be configured to enclose a portion of the optical bench.

DETAILED DESCRIPTION

Figure 1:
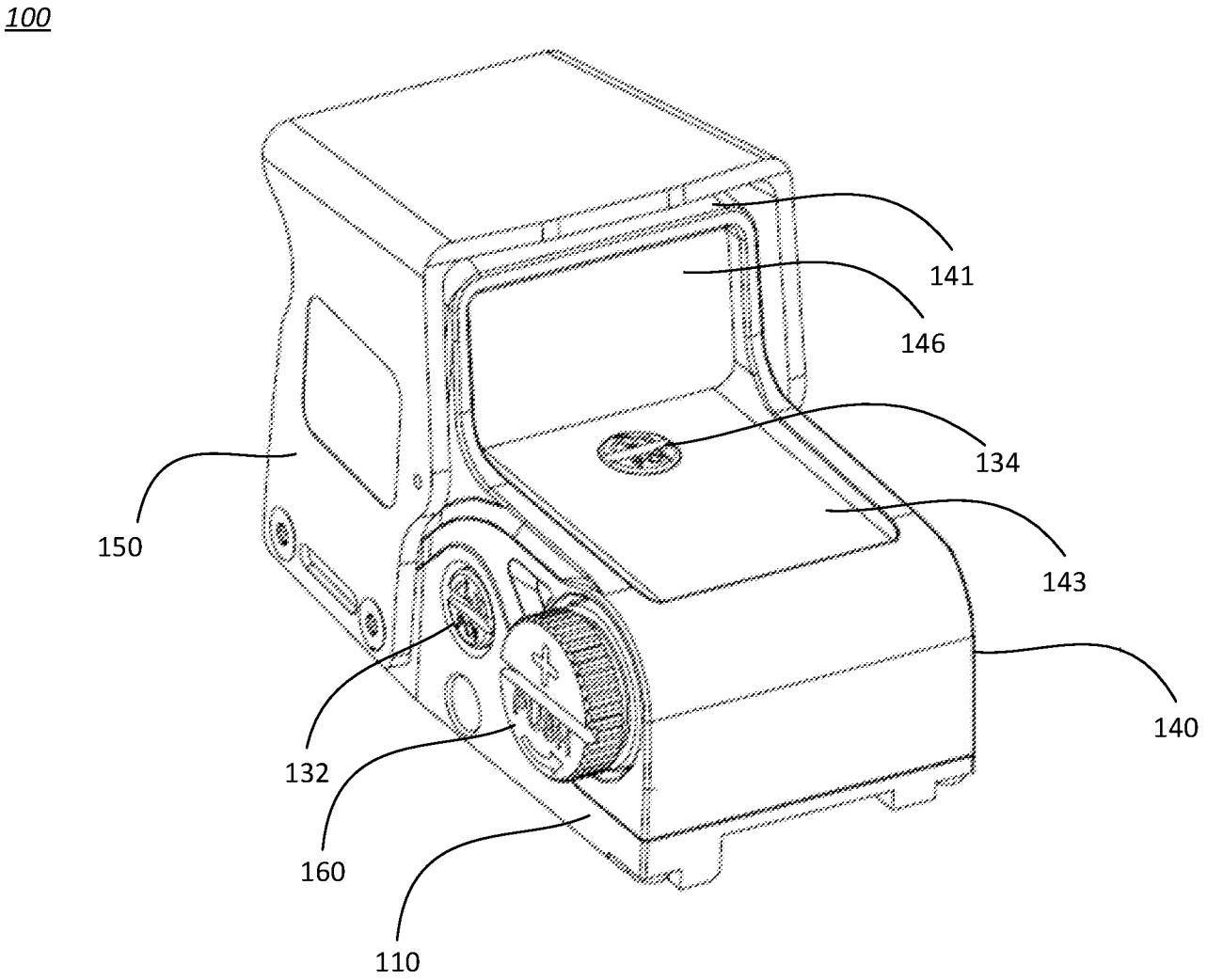
FIG. 1 is a front perspective view of an example modular weapon sight.

Methods and systems are disclosed for a weapon sight with a tapered housing. Holographic sights may employ a series of optical components to generate a hologram for presentation to the operator. For example, a holographic sight may employ a laser diode that generates a light beam, a mirror that deflects the light beam, a collimating optic that receives the deflected light beam and reflects collimated light, a grating that receives the collimated light and diffracts light toward an image hologram that has been recorded with an image and which displays the image to the operator of the sight.

Holographic sights may position optical components relative to each other by affixing them to structures in a holographic sight. For example, optical components such as, for example, the collimating optic and the hologram image may be affixed to an interior of a holographic sight housing. The mirror may be positioned on a podium extending from a mount to which the sight housing is attached. The grating may be affixed to a moveable plate configured to rotate relative to the sight housing.

The sight housing may determine a field of view. The field of view may be defined as a width of view and/or a height of view at a predefined distance from the weapon sight. The walls of the sight housing may be slanted from the operator-side to the target-side. The size of the windows in the sight housing may be configured to achieve a certain field of view (e.g., horizontal and/or vertical). For example, a size of the windows in the sight housing may be adjusted to achieve a desired field of view (e.g., horizontal and/or vertical) of the weapon sight.

Applicant discloses herein a weapon sight that employs a tapered housing. The housing may be tapered such that the view area closest to the operator is smaller than the view area closest to the target. Stated differently, a profile of the housing (e.g., outer walls) may be tapered out from a rear window (e.g., operator-side window) to a front window (e.g., target-side window) such that the field of view is larger than if the profile of the housing was straight (e.g., not tapered). For example, walls of the housing may be angled to follow the field of view. Stated differently, the walls of the housing may be farther apart at the front window than at the rear window. The front window of the housing may be larger than the rear window of the housing. For example, when the front window of the housing is larger than the rear window of the housing, the field of view may be larger than if the rear window and the front window were the same size. The tapered housing may minimize obscuration of the scene that an operator of the weapon is observing. The tapered housing may result in an increased view of the downfield theater and faster target acquisition by an operator of the weapon. The tapered housing may provide a view with more awareness of the surrounding environment.

FIGS. 1-11B illustrate an example weapon sight 100. The weapon sight 100 may be a modular weapon sight. The weapon sight 100 may include a base 110, an optical bench 120, an adjuster assembly 130, a housing 140, and/or a hood 150. The base 110, the optical bench 120, the adjuster assembly 130, the housing 140, and the hood 150 may be configured as separate modules. For example, the base 110 may be referred to as a base module; the optical bench 120 may be referred to as an optical bench module; the adjuster assembly 130 may be referred to as an adjuster assembly module; the housing 140 may be referred to as a housing module; and the hood 150 may be referred to as a hood module.

The base 110 may be configured to attach to a weapon (e.g., such as a hand gun, a rifle, a shotgun, a bow, etc.). For example, the base 110 may be configured to attach (e.g., removably attach) to an upper surface (e.g., a rail) of the weapon. The base 110 may include a lever arm 112 that is mounted (e.g., pivotally mounted) to the base 110. The lever arm 112 may be configured to be operated between an open position and a closed position such that the base 110 is configured to be removably attached to the weapon. For example, the lever arm 112 may be configured to engage a complementary feature on the upper surface of the weapon. The base 110 may define an upper surface 114. The optical bench 120 and the adjuster assembly 130 may be secured to the upper surface 114 of the base 110.

The base 110 may define a first extension 116 and a second extension 118. The first extension 116 and the second extension 118 may be on opposed sides of the base 110. The first extension 116 may include a first aperture 111. The first aperture 111 may be configured to receive a portion of the adjuster assembly 130. For example, the portion of the adjuster assembly 130 may be accessible via the first aperture 111. The second extension 118 may include a plurality of second apertures 113. The plurality of second apertures 113 may be configured to receive respective buttons 172 of an electronics module 170. For example, the buttons 172 may be accessible via the plurality of second apertures 113.

The weapon sight 100 may include a battery module 160. The battery module 160 may be configured to store a battery (not shown) that is configured to power a laser (e.g., such as laser diode 534 shown in FIGS. 10-11).

The weapon sight 100 may be a holographic weapon sight. The optical bench 120 may include a plurality of optical elements. The optical bench 120 (e.g., the plurality of optical elements) may be configured to reconstruct a holographic reticle. For example, the plurality of optical elements may include a laser diode, a mirror, a collimator, a grating, and/or a hologram plate. The optical bench 120 (e.g., the plurality of optical elements) may define an optical path. For example, a relative position of the plurality of optical elements may define the optical path.

The optical bench 120 may include an optical bench base 125, a support member 121, and a unitary optical component carrier 127. The support member 121 may be integrally formed with the optical bench base 125 and may extend upward from the optical bench base 125. The unitary optical component carrier 127 may be integrally formed with the support member 121. The optical bench base 125 may be secured to the base 110. For example, the optical bench base 125 may be secured to the base 110 using screws that extend through openings in the optical bench base 125 and into corresponding receptacles in the base 110. The support member 121 and/or the unitary optical component carrier 127 may be suspended relative to the base 110 by the optical bench base 125.

The optical bench 120 may include one or more portions that are flexible (e.g., compliant) such that the unitary optical component carrier 127 may be moveable in a horizontal and/or a vertical direction relative to the optical bench base 125 and/or the base 110. The one or more flexible portions of the optical bench 120 may include a flexible member 123, a first horizontal member 126, a second horizontal member 128, and/or a joint member 129. The one or more flexible portions of the optical bench 120 may be compliant so as to allow for adjustment of the position of the unitary optical component carrier 127 relative to the optical bench base 125 and/or base 110 and thereby allow for adjusting a position of a hologram in a viewing area of the weapon sight 100. For example, the flexible member 123 may be configured to flex (e.g., twist and/or rotate) to enable horizontal movement (e.g., adjustment) of the unitary optical component carrier 127. The joint member 129 may flex to enable vertical movement (e.g., adjustment) of the unitary optical component carrier 127. The optical bench 120 may include one or more portions that are non-compliant (e.g., inflexible). The one or more non-compliant portions of the optical bench 120 may include the support member 121, a first wall 122, and a second wall 124.

The adjuster assembly 130 may be configured to adjust a positioning of the optical bench 120. For example, the adjuster assembly 130 may include a first adjuster 132 and a second adjuster 134. The first adjuster 132 may be configured to horizontally adjust a position of a holographic reticle. For example, rotation of the first adjuster 132 may result in a horizontal adjustment of the holographic reticle. The second adjuster 134 may be configured to vertically adjust the position of the holographic reticle. For example, rotation of the second adjuster 134 may result in a vertical adjustment of the holographic reticle. The first adjuster 132 may be accessible (e.g., to rotate) through the base 110. The second adjuster 134 may be accessible (e.g., to rotate) through the housing 140.

A distal portion 131 of the first adjuster 132 may abut the optical bench 120. A distal portion 133 of the second adjuster 134 may abut the optical bench 120. The distal portion 131 of the first adjuster 132 may be configured to move a portion of the optical bench 120, for example, without altering a relative position of the plurality of optical elements with respect to one another. Stated differently, operation of the first adjuster 132 may adjust a position of the holographic reticle without affecting the optical path of the optical bench 120.

Figure 12:
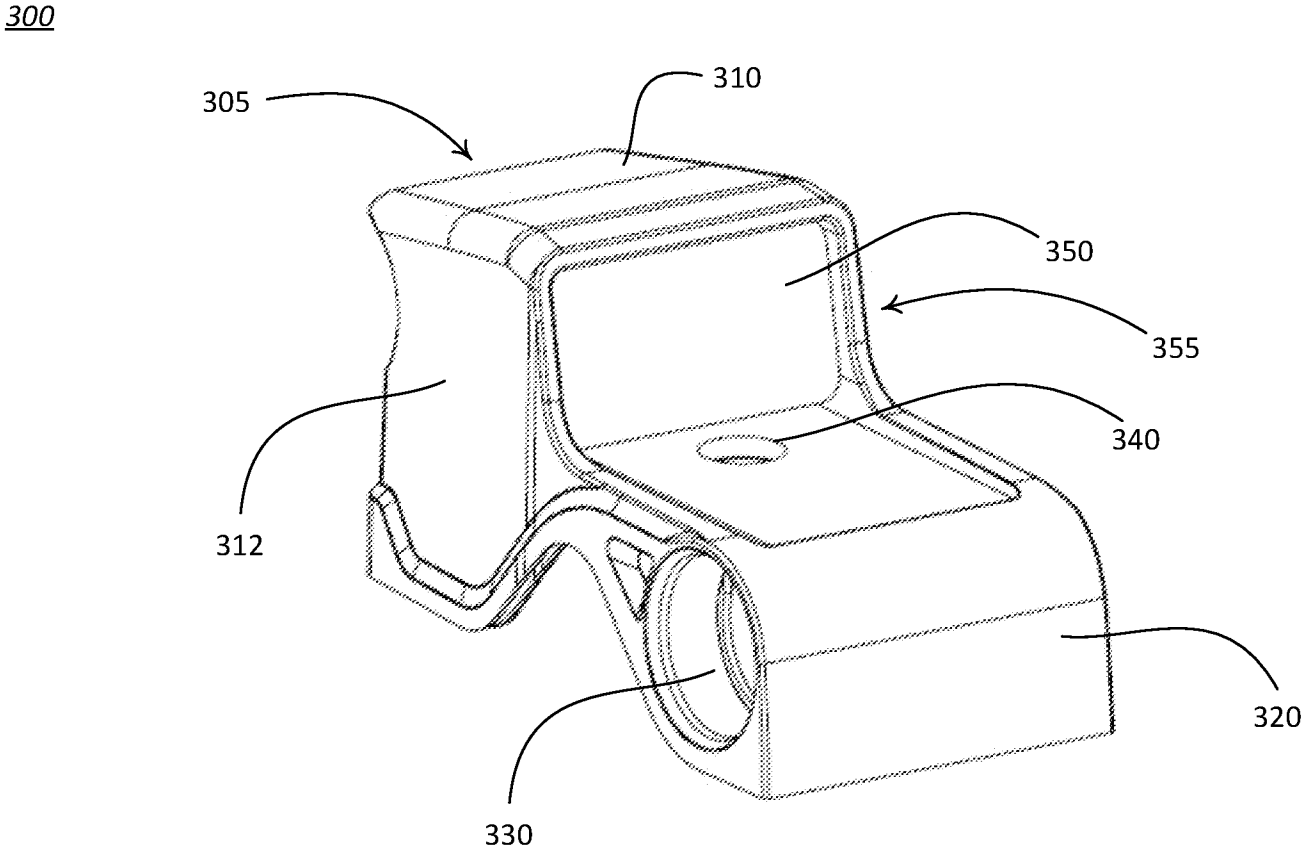
FIG. 12 is a front perspective view of an example weapon sight housing.
Figure 13:
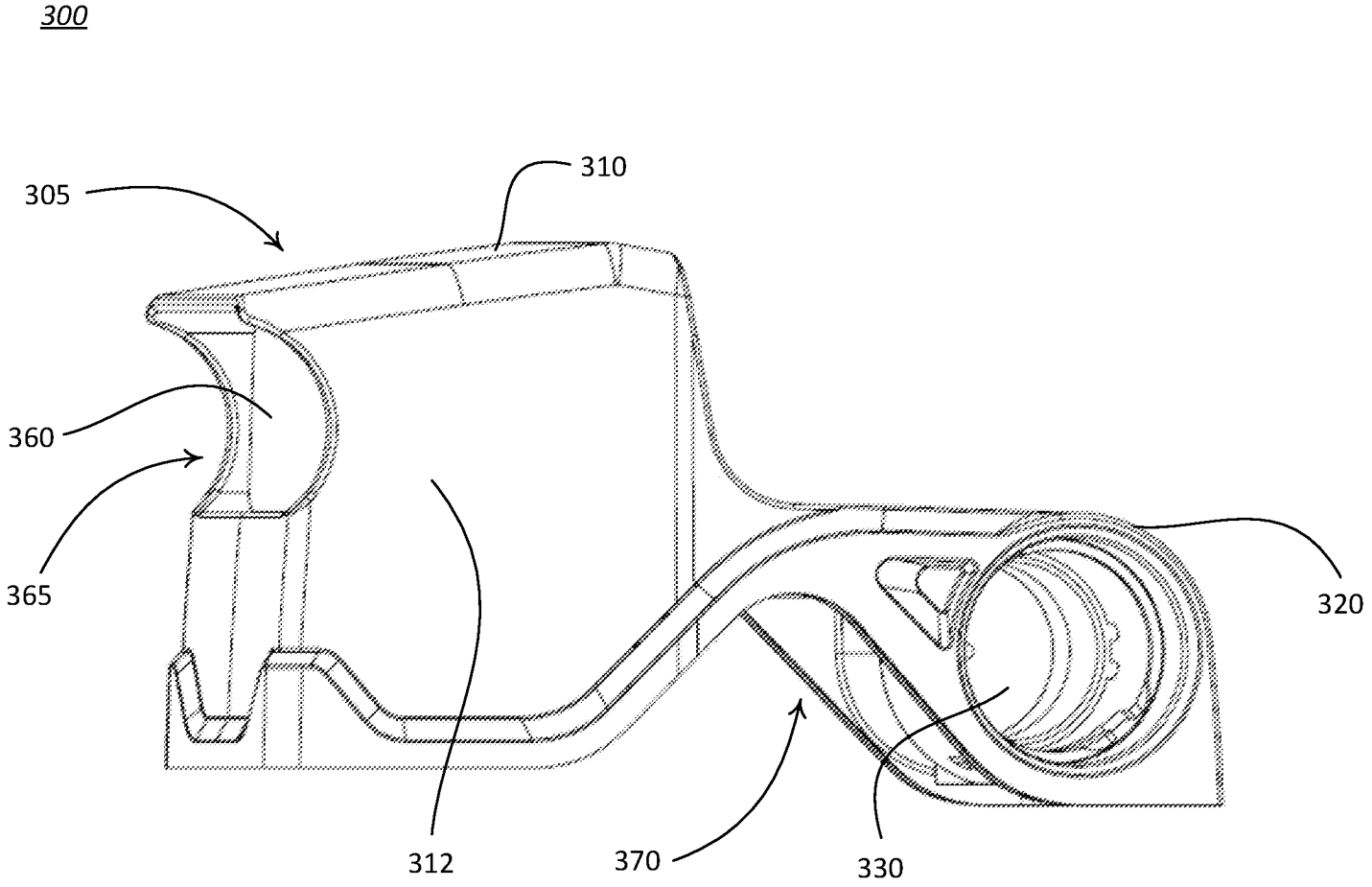
FIG. 13 is another perspective view of the example weapon sight housing shown in FIG. 12.
Figure 14:
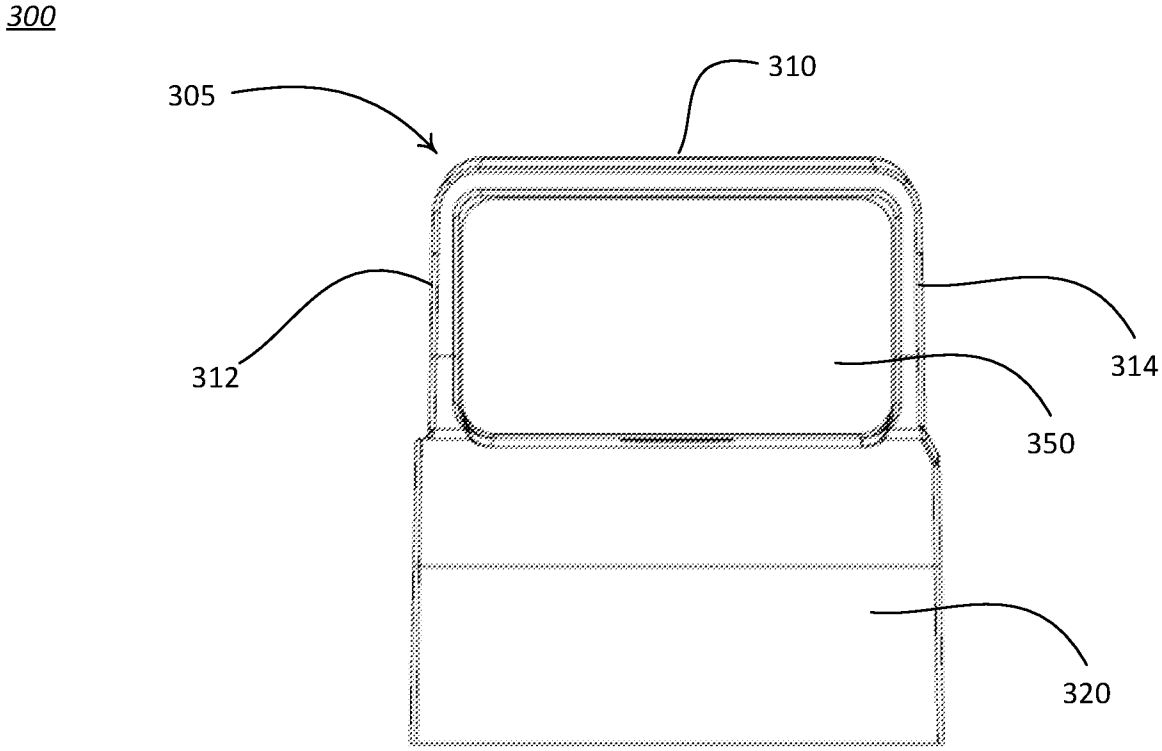
FIG. 14 is a front view of the example weapon sight housing shown in FIG. 12.
Figure 15:
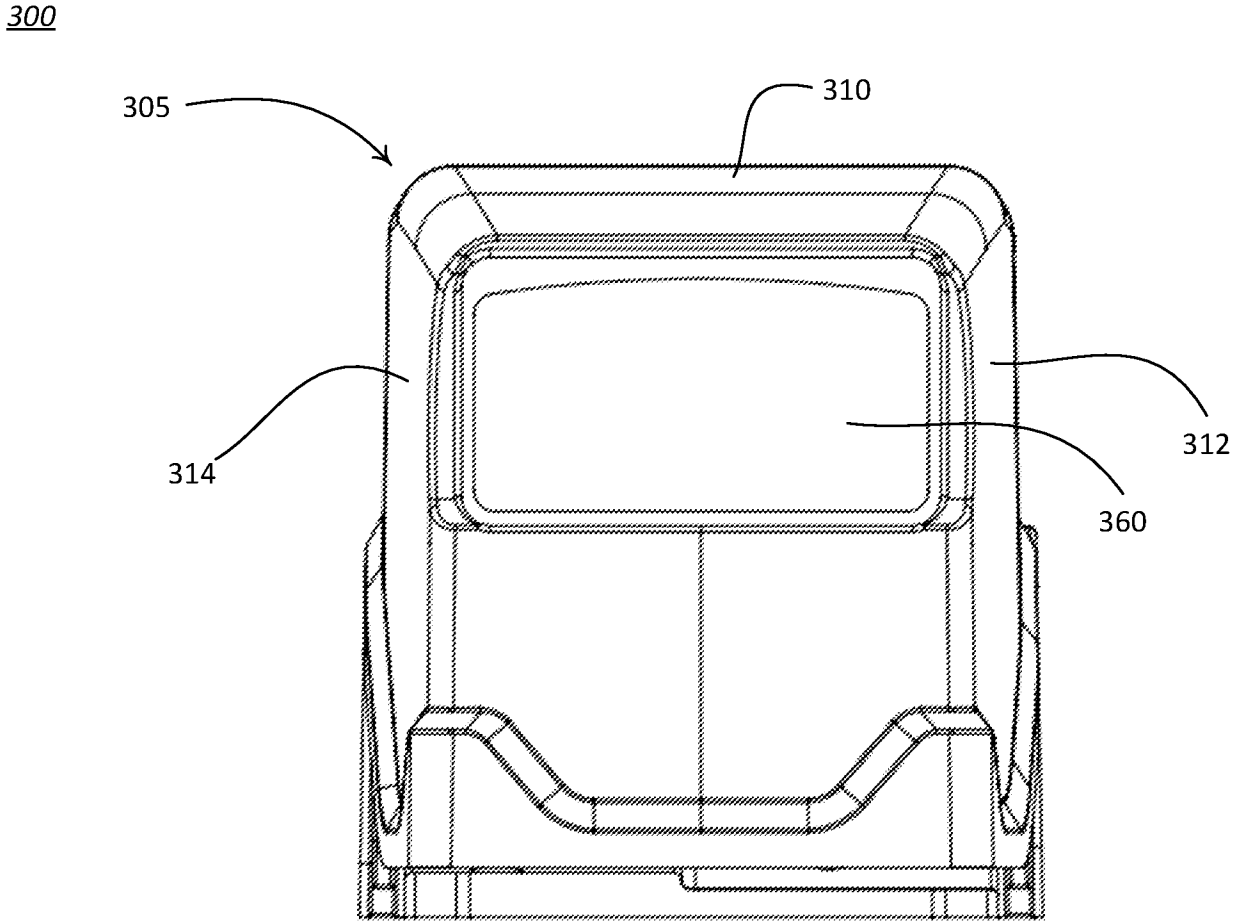
FIG. 15 is a rear view of the example weapon sight housing shown in FIG. 12.
Figure 16:
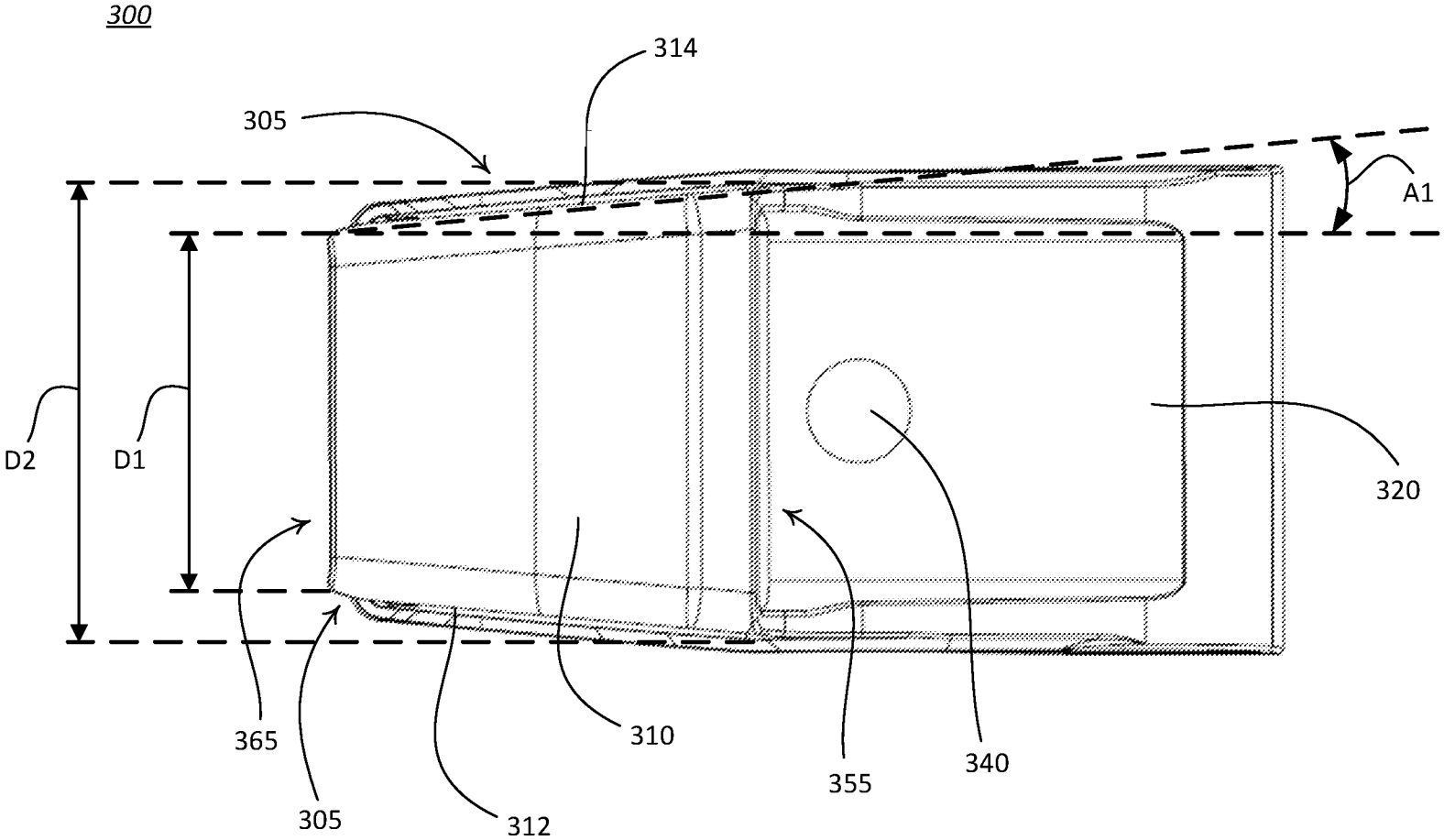
FIG. 16 is a top view of the example weapon sight housing shown in FIG. 12.
Figure 17:
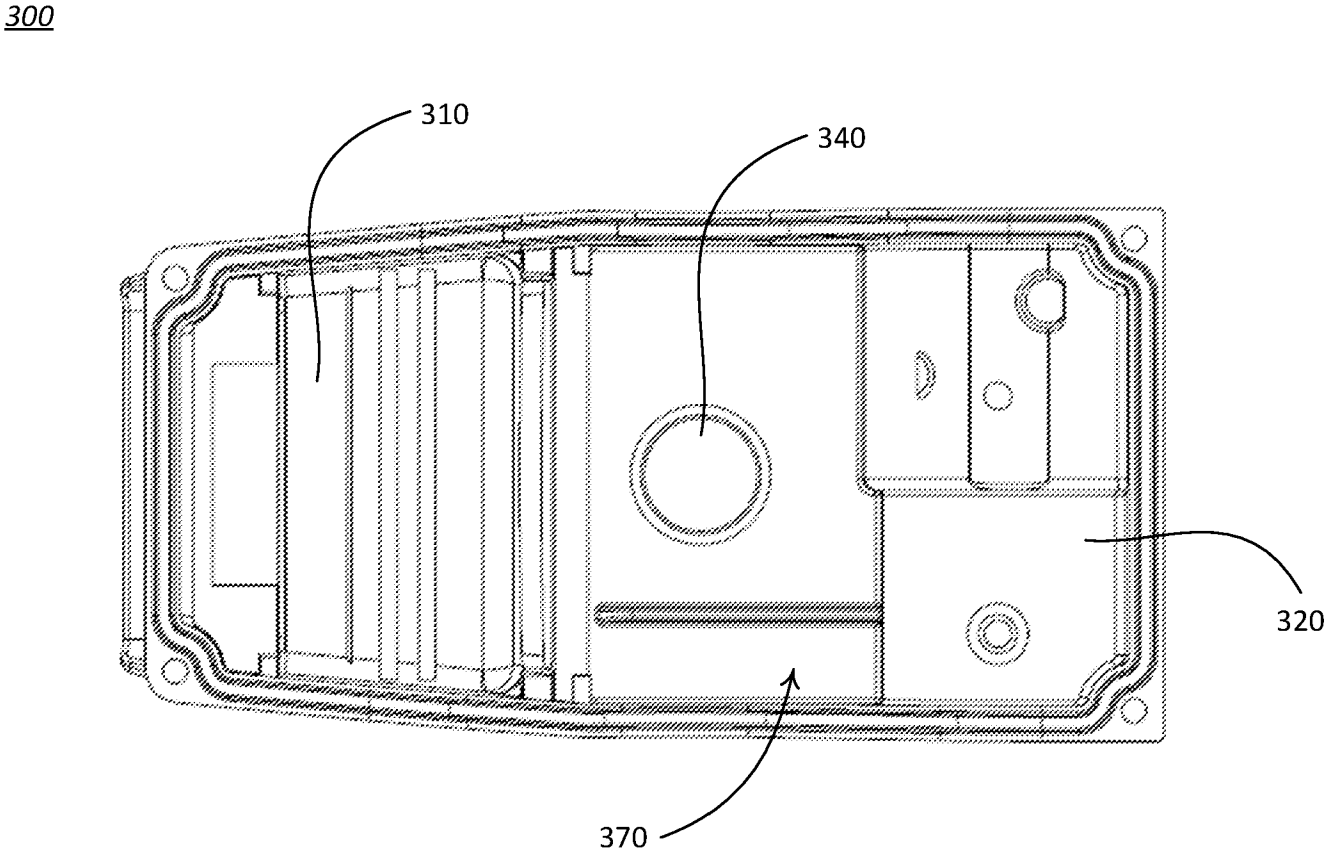
FIG. 17 is a bottom view of the example weapon sight housing shown in FIG. 12.

The housing 140 may be configured to enclose the optical bench 120, the adjuster assembly 130, the battery module 160, and/or an electronics module 170. The housing 140 may define an upper portion 141 and a lower portion 143. The lower portion 143 may be configured to enclose the adjuster assembly 130, the battery module 160, the electronics module 170, and a lower portion of the optical bench 120. The upper portion 141 may be configured to enclose an upper portion of the optical bench 120. The housing 140 (e.g., the lower portion 143) may define a first aperture (e.g., such as the first aperture 330 shown in FIGS. 12 and 13) and a second aperture 144. The first aperture may be configured to receive a portion of the battery module 160. The second aperture 144 may be configured to receive a portion of the second adjuster 134. The housing 140 may define an upper portion 141 and a lower portion 143.

The housing 140 (e.g., the upper portion 141) may define a front window 146 and a rear window 148. The front window 146 may represent the target-side window of the weapon sight 100. The rear window 148 may represent the operator-side window of the weapon sight 100. For example, a user of the weapon sight 100 may look through the rear window 148 and then through the front window 146 when using the weapon sight 100. A hologram of the weapon sight 100 may appear to be projected through the front window 146 of the weapon sight 100. The housing 140 may define the viewing area of the weapon sight 100. For example, the front window 146 and the rear window 148 may define the viewing area of the weapon sight. Stated differently, respective sizes of the front window 146 and the rear window 148 may define the viewing area of the weapon sight.

The hood 150 may be configured to protect the housing 140 (e.g., the upper portion 141 of the housing 140). For example, the hood 150 may be secured to the base 110. When the hood 150 is secured to the base 110, the hood 150 may surround the upper portion 141 of the housing 140.

FIGS. 12-17 depict an example housing 300 for a weapon sight (e.g., such as weapon sight 100 shown in FIGS. 1-11B). The housing 300 (e.g., such as housing 140 shown in FIGS. 1-9) may be configured to enclose the optical elements of the weapon sight. For example, the housing 300 may define a cavity 370. The cavity 370 may be configured to receive the optical bench and/or the adjuster assembly. The housing 300 may define an outer shell 305. The outer shell 305 may define an outer surface of the housing 300. The outer shell 305 may define a first window opening 365 and a second window opening 355.

The outer shell 305 may include an upper portion 310 (e.g., such as upper portion 141 shown in FIGS. 1-11B) and a lower portion 320 (e.g., such as lower portion 143 shown in FIGS. 1-11B). The lower portion 320 may be configured to enclose an adjuster assembly (e.g., such as adjuster assembly 130 shown in FIGS. 1-11B), a battery module (e.g., such as the battery module 160 shown in FIGS. 1-11B), an electronics module (e.g., the electronics module 170 shown in FIGS. 1-11B), and a lower portion of an optical bench (e.g., the optical bench 120 shown in FIGS. 1-11B). The upper portion 310 may be configured to enclose an upper portion of the optical bench. The housing 300 (e.g., the lower portion 320) may define a first aperture 330 and a second aperture 340 (e.g., such as the second aperture 144 shown in FIG. 3). The first aperture 330 may be configured to receive a portion of the battery module. The second aperture 340 may be configured to receive a portion of the adjuster assembly (e.g., such as the second adjuster 134 as shown in FIG. 1). For example, the housing 300 may define a cavity 370. The cavity 370 may be configured to receive the optical bench and/or the adjuster assembly. The cavity 370 may be defined within the upper portion 310 and the lower portion 320.

Figure 2:
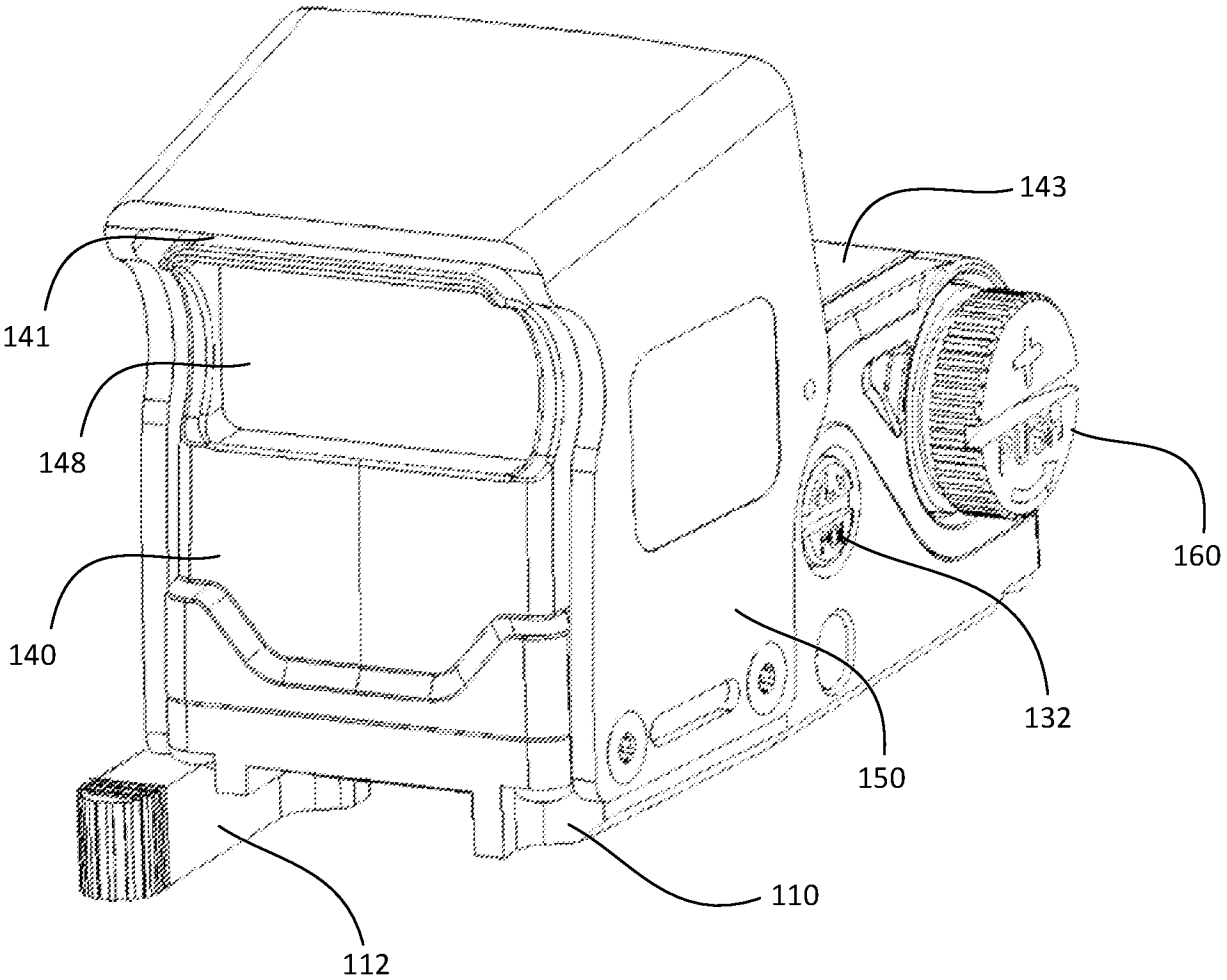
FIG. 2 is a rear perspective view of the example modular weapon sight shown in FIG. 1.
Figure 3:
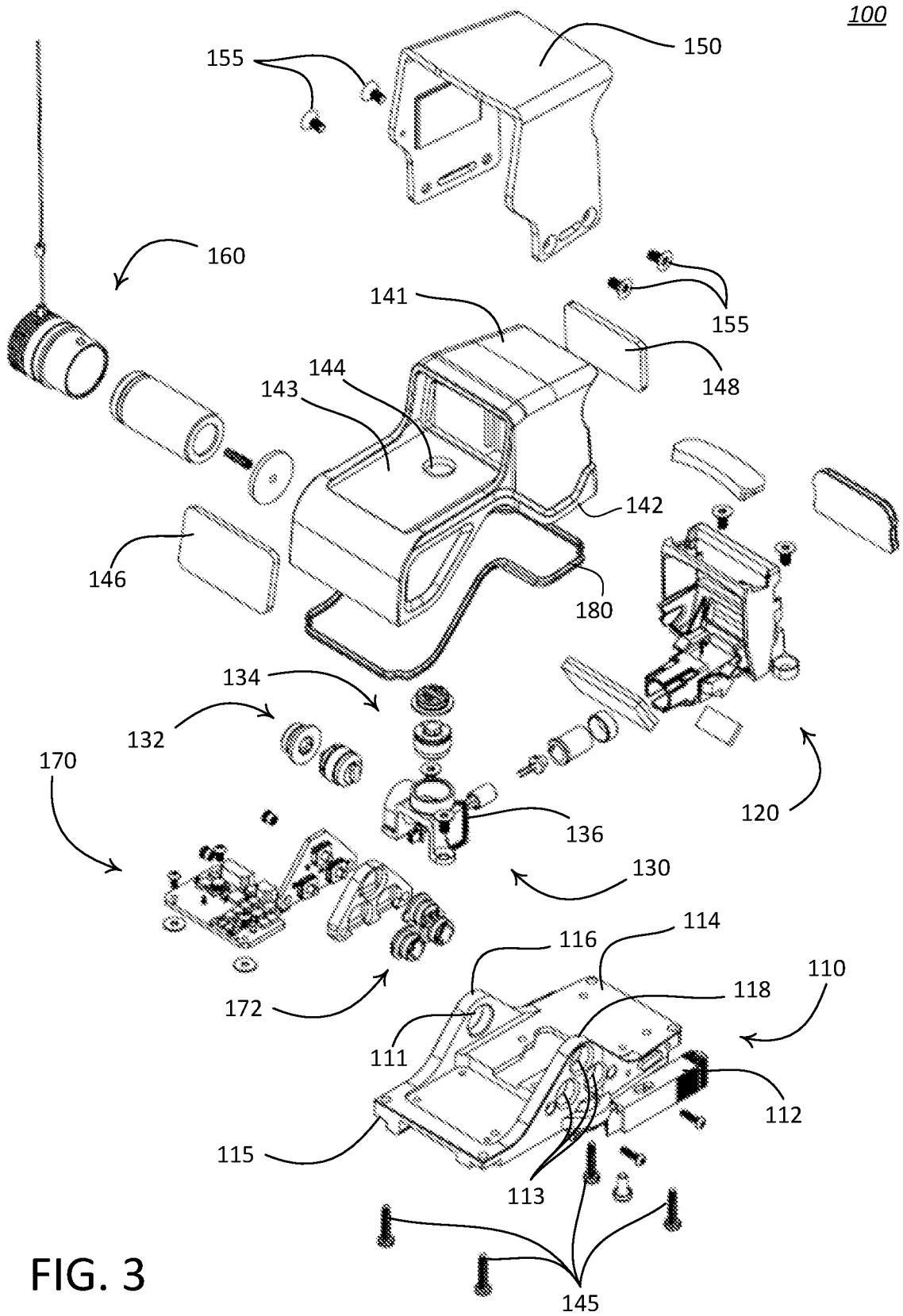
FIG. 3 is a partially exploded view of the example modular weapon sight shown in FIG. 1.
Figure 4:
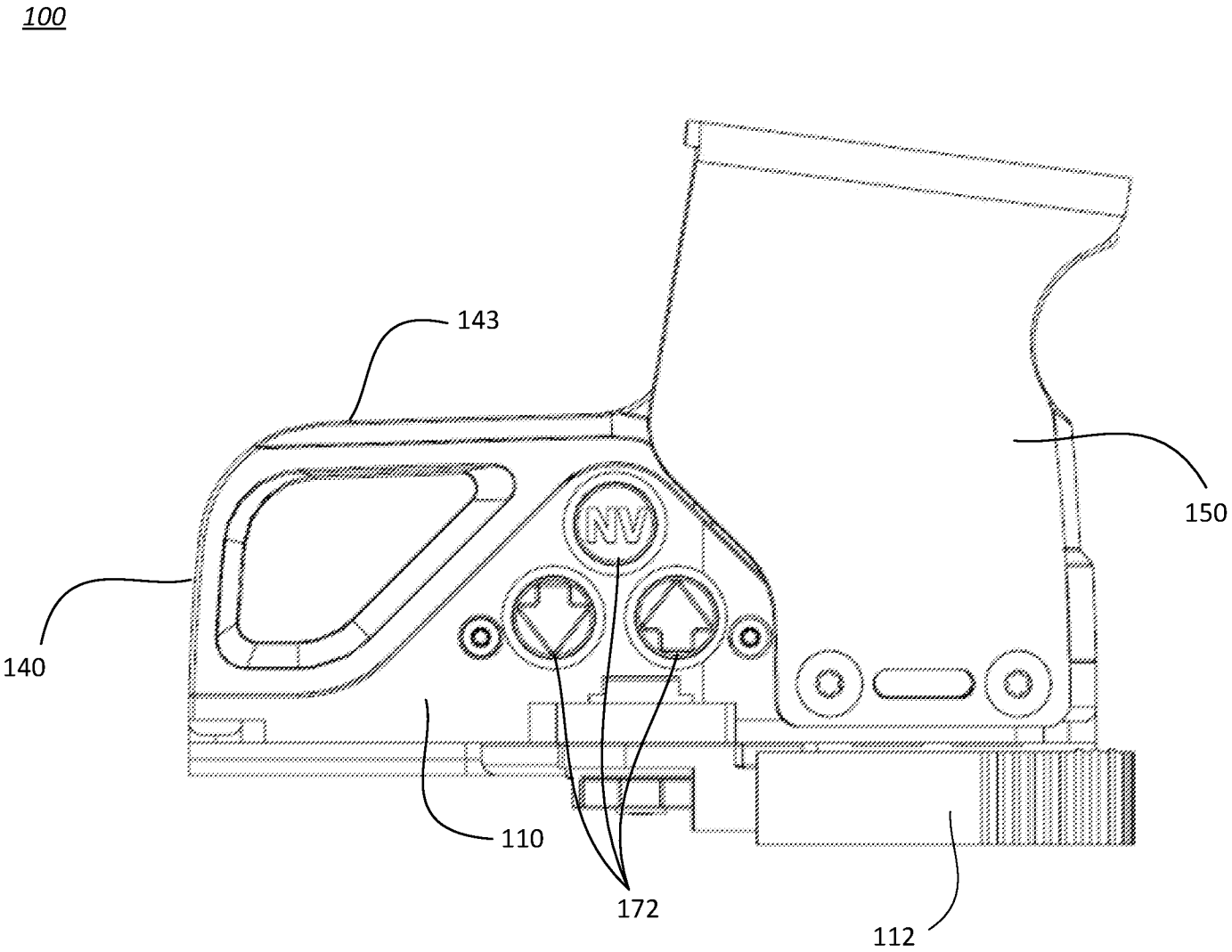
FIG. 4 is a side view of the example modular weapon sight shown in FIG. 1.
Figure 5:
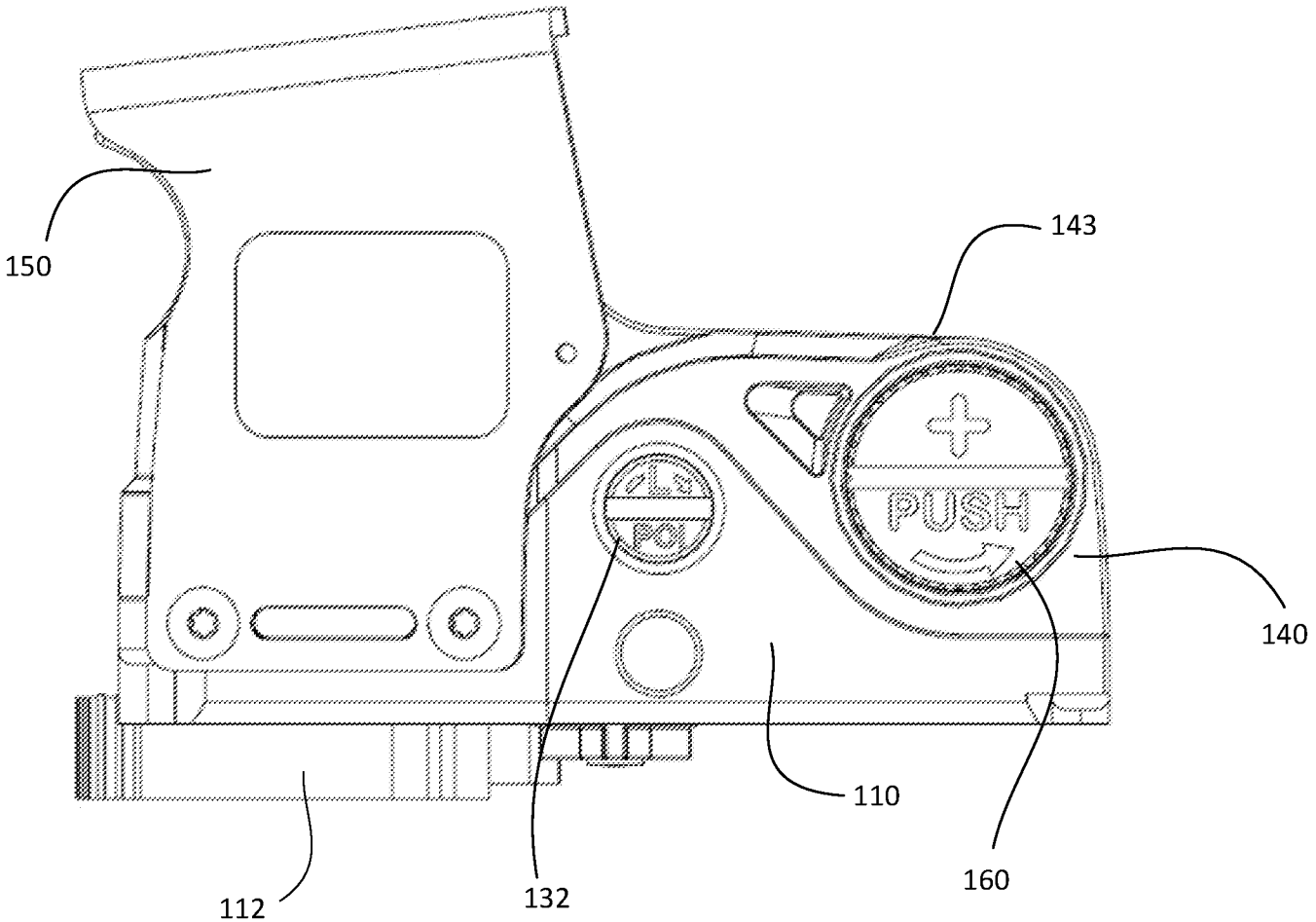
FIG. 5 is another side view of the example modular weapon sight shown in FIG. 1.
Figure 6:
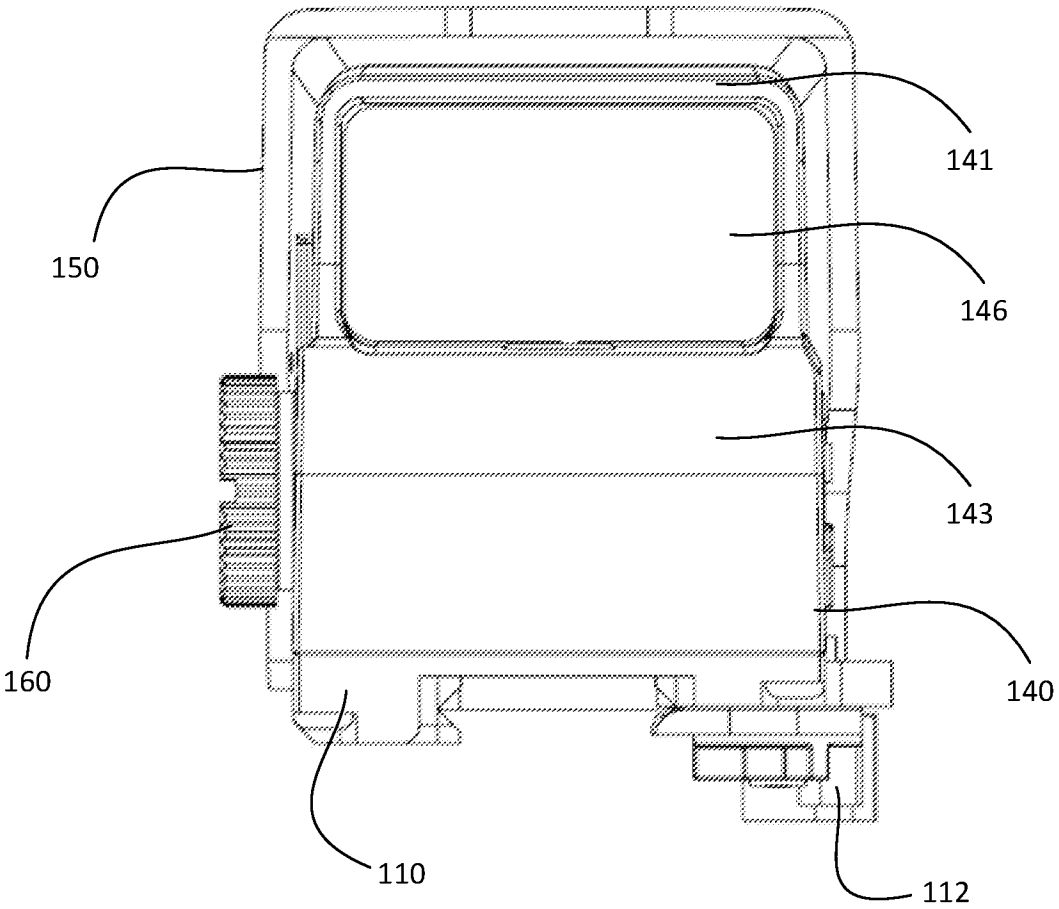
FIG. 6 is a front view of the example modular weapon sight shown in FIG. 1.
Figure 7:
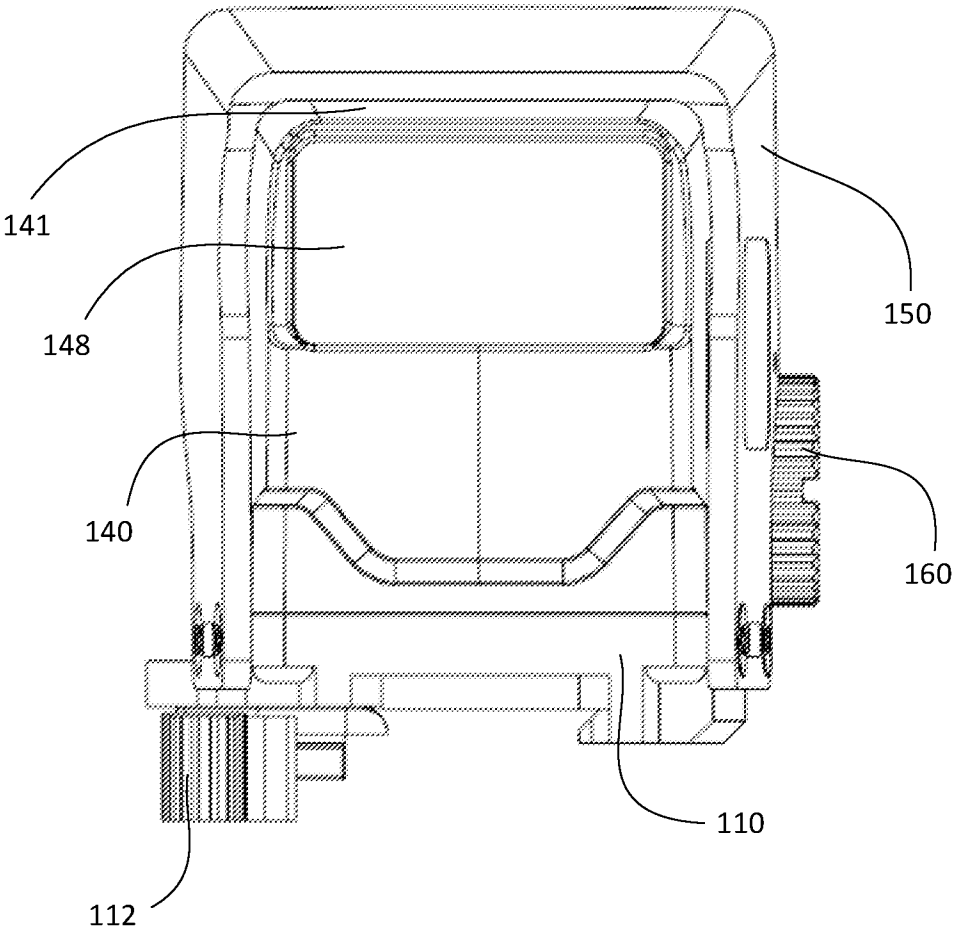
FIG. 7 is a rear view of the example modular weapon sight shown in FIG. 1.
Figure 8:
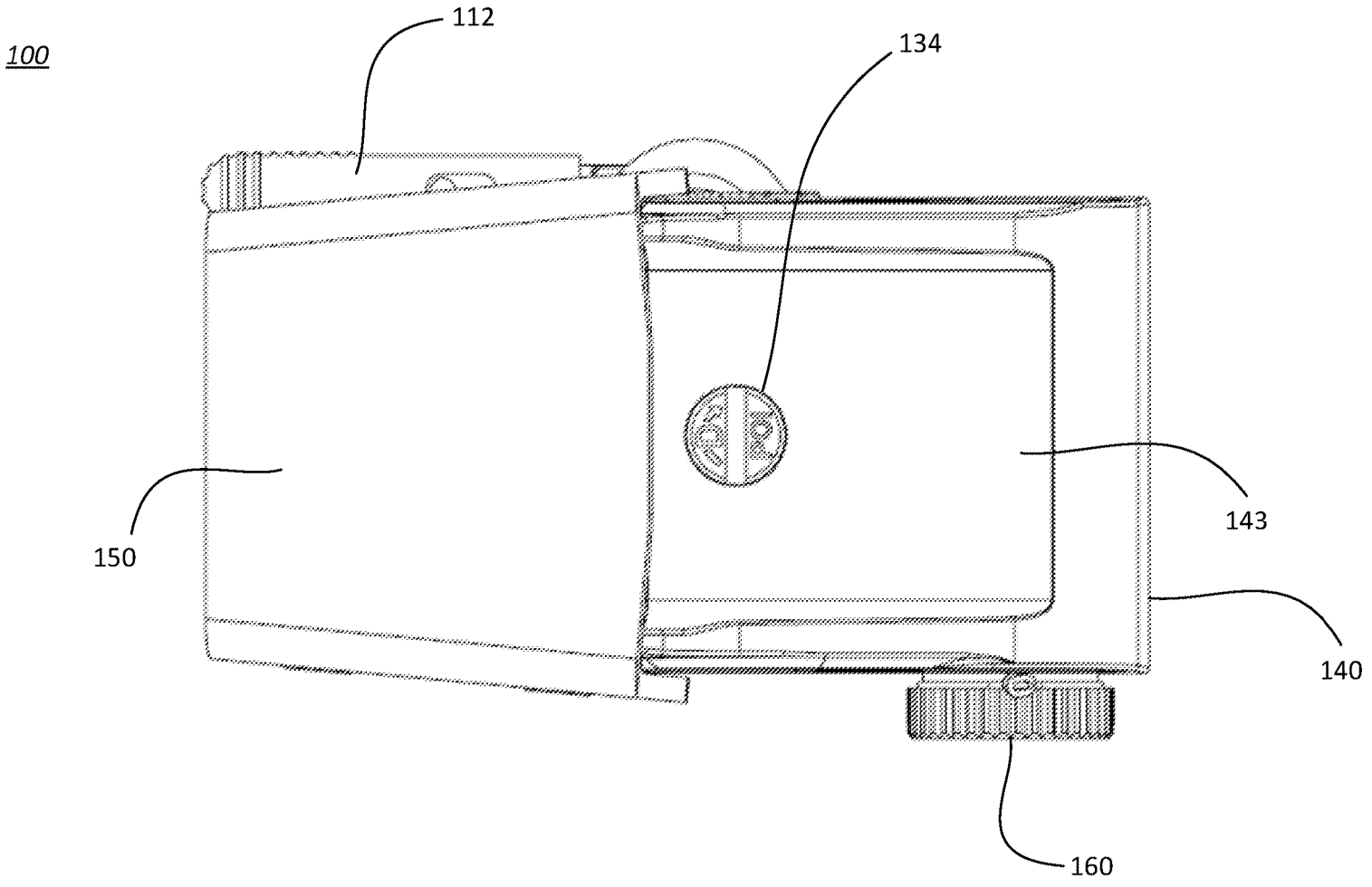
FIG. 8 is a top view of the example modular weapon sight shown in FIG. 1.
Figure 9:
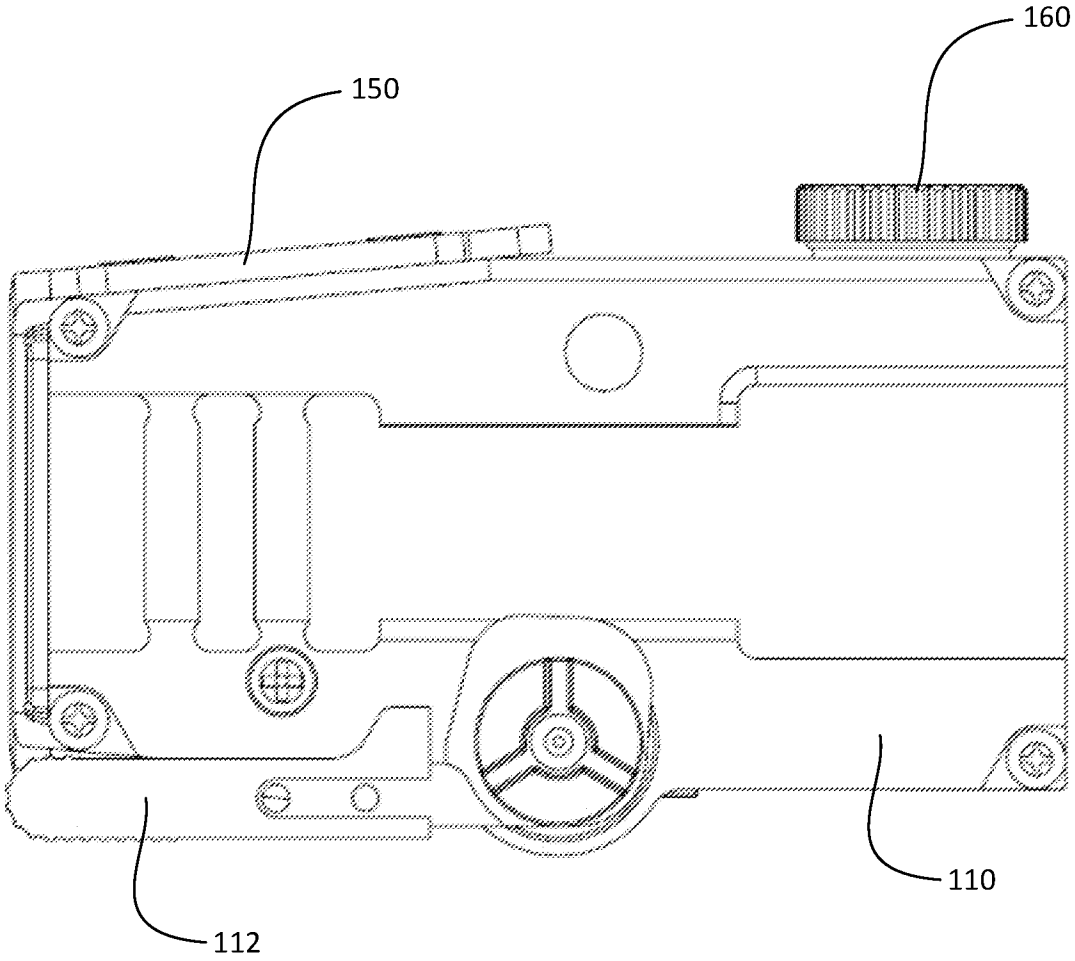
FIG. 9 is a bottom view of the example modular weapon sight shown in FIG. 1.
Figure 10:
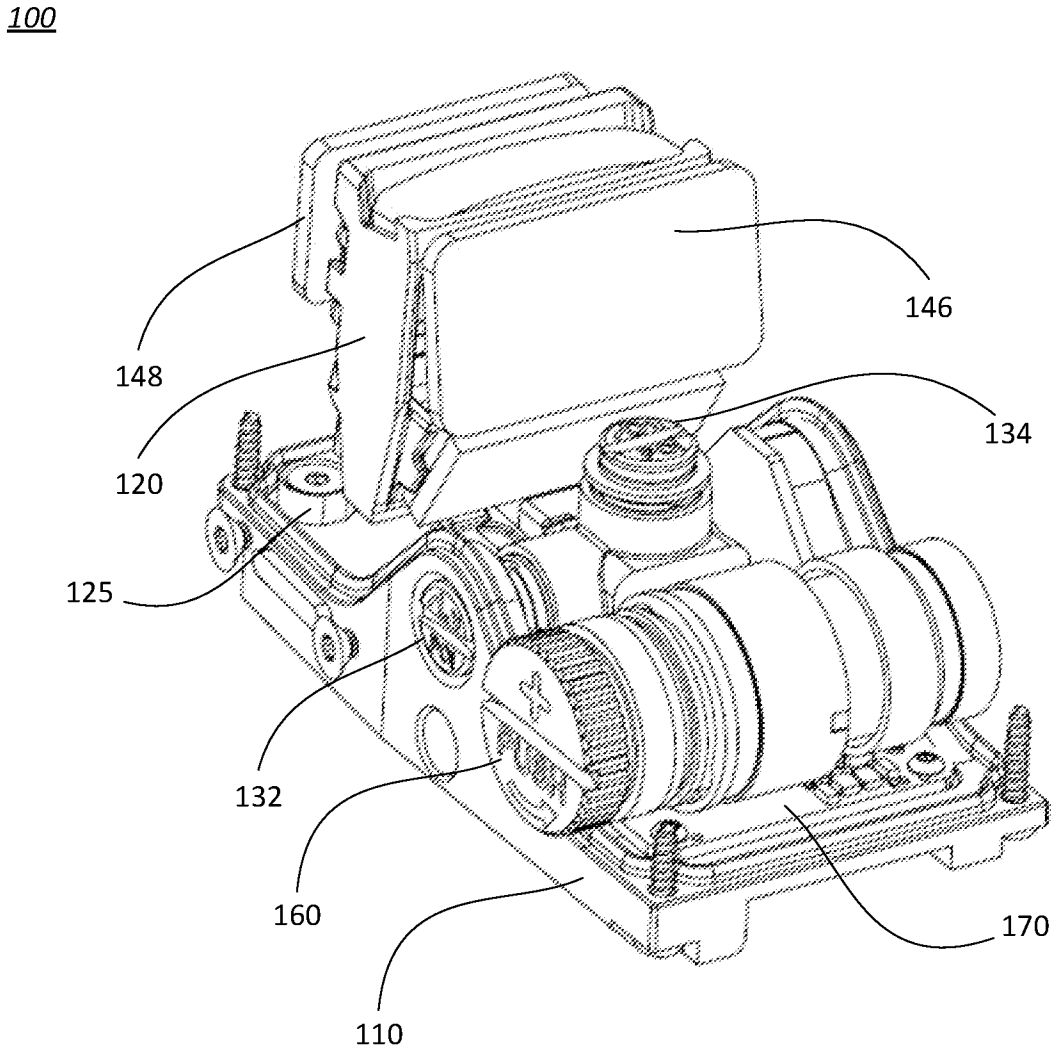
FIG. 10 is a perspective view of the example modular weapon sight shown in FIG. 1 with the hood and housing removed.
Figure 11B:
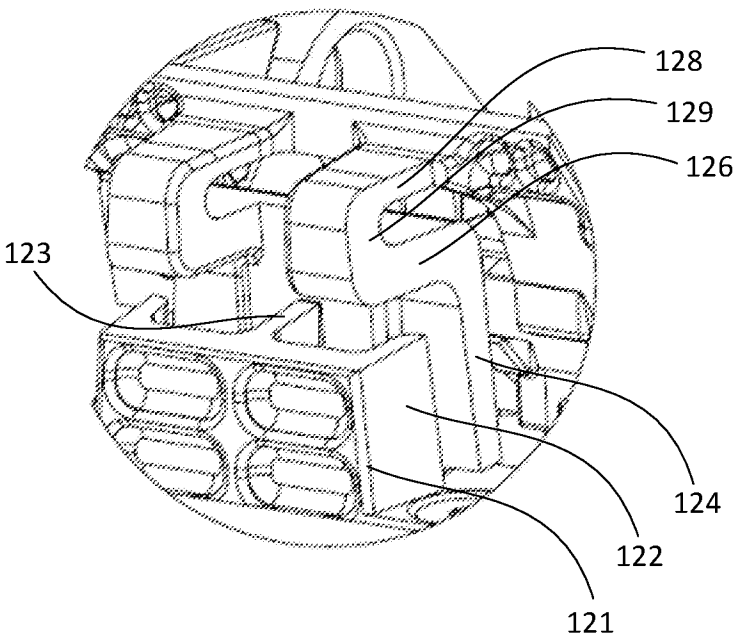
FIG. 11B is a detailed view of a portion of the example optical chassis shown in FIG. 11A.
Figure 11A:
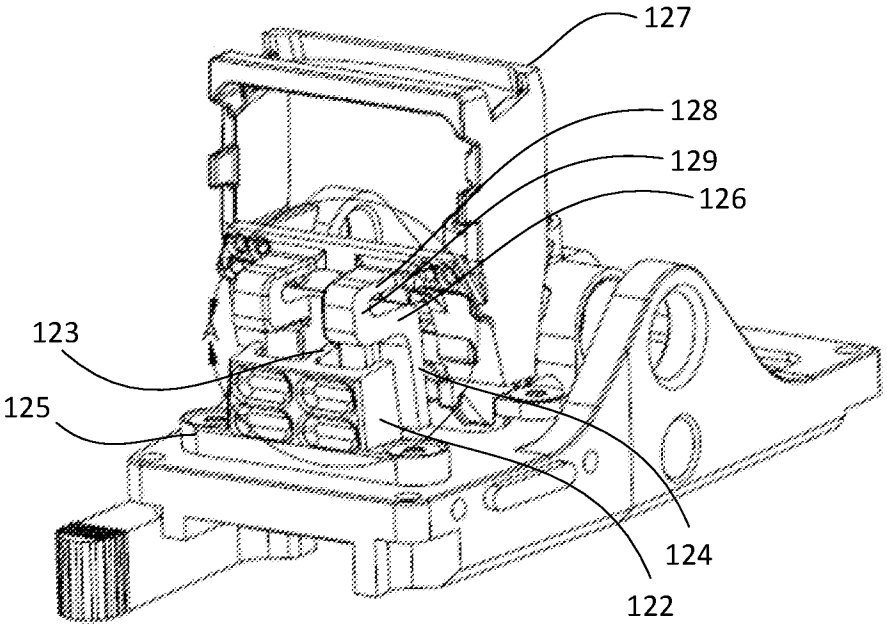
FIG. 11A is a perspective view of an example optical chassis attached to an example mount.

The housing 300 (e.g., the upper portion 310) may include a front window 350 (e.g., such as front window 146 shown in FIG. 1) and a rear window 360 (e.g., such as rear window 148 shown in FIG. 2). The front window 350 may be a target-side window. For example, the front window 350 may face a target when the weapon sight is mounted to a weapon. The rear window 360 may be an operator-side window. For example, the rear window 360 may face an operator (e.g., a user) of the weapon when the weapon sight is mounted to a weapon. The rear window 360 may be located at a first window opening 365. The first window opening 365 may be configured to receive the rear window 360. For example, the rear window 360 may be secured within the first window opening 365. The front window 350 may be located at a second window opening 355. The second window opening 355 may be configured to receive the front window 350. For example, the front window 350 may be secured within the second window opening 355.

The housing 300 may be tapered. The housing 300 (e.g., the upper portion 310) may include a first wall 312 and a second wall 314. The first wall 312 and the second wall 314 may extend between the front window 350 and the rear window 360, for example, on opposed sides of the optical path. The first wall 312 and the second wall 314 may be slanted (e.g., angled) outward from the rear window 360 to the front window 350. At the rear window 360, the first wall 312 may be a distance D1 from the second wall 314. At the front window 350, the first wall 312 may be a distance D2 from the second wall 314. D2 may be greater than D1. Stated differently, the first wall 312 and second wall 314 may be farther apart at the front window 350 than at the rear window 360.

The housing 300 may be tapered at an angle A1. For example, the first wall 312 and the second wall 314 may be tapered by the angle A1. The angle A1 may be determined based on a distance between a user's eye (e.g., user's eye 500 shown in FIG. 19) and the rear window 360. The angle A1 may be determined based on a predetermined horizontal field of view for the weapon sight. The predetermined horizontal field of view may be associated with a specific use case. For example, the weapon sight may be configured for a specific weapon and/or a specific use case. The specific weapon and/or specific use case may require a specific horizontal field of view. The angle A1 may be determined based on the specific weapon and/or the specific use case. A user of the specific weapon may position their eye a predetermined distance from the rear window 360. The angle A1 may be determined using the predetermined distance and the specific horizontal field of view such that obscuration (e.g., horizontal obscuration) of the field of view is minimized. When the horizontal obscuration of the field of view is minimized, situational awareness may be maximized for the user. For example, the angle A1 may be determined such that a horizontal area obscured by the housing 300 is below a predefined threshold for the specific horizontal field of view. The predefined threshold may be defined by one or more requirements of the specific weapon.

The front window 350 may determine the field of view for the weapon sight. For example, a size of the front window 350 may be correlated with the field of view of the weapon sight. The front window 350 may be larger than the rear window 360. For example, the front window 350 may be wider than the rear window 360. A length of the rear window 360 may be configured based on D1. A length of the front window 350 may be configured based on D2. The length of the front window 350 may be greater than the length of the rear window 360. The front window 350 and the rear window 360 may have the same height. When the front window 350 is larger than the rear window 360, obscuration from the walls 312, 314 may be reduced when compared to when the front window 350 is the same size as the rear window 360.

The housing 300 may be configured to protect the weapon sight. The housing 300 may be configured to be installed, adjusted, and/or replaced without affecting an optical path of the weapon sight. For example, the housing 300 may be a replacement housing for the weapon sight.

Figure 18:
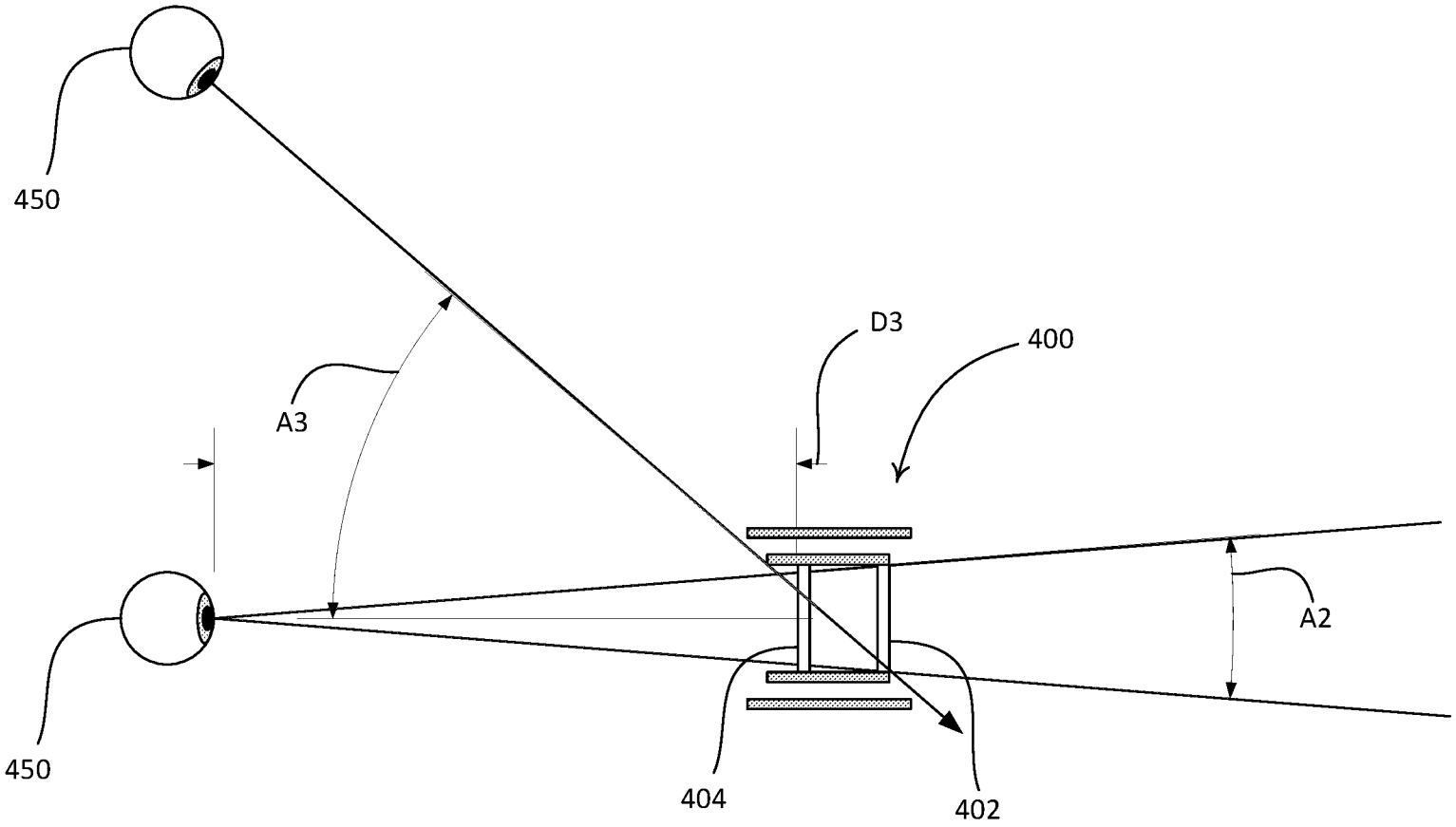
FIG. 18 is a diagram of the horizontal field of view and the horizontal obscurance of an example weapon sight.

FIG. 18 depicts an example horizontal field of view and an example horizontal obscurance of an example weapon sight 400 (e.g., such as the weapon sight 100 shown in FIGS. 1-10). The weapon sight 400 may define a front window 402 and a rear window 404. A user of the weapon sight 400 may position their eye 450 a certain distance from the rear window 404. When a user's eye 450 is a distance D3 from the rear window 404, the horizontal field of view may be defined by an angle A2. The distance D3 may be approximately 15 cm. The angle A2 may be approximately 9.1 degrees, for example, when the user's eye 450 is aligned with the center of the weapon sight 400. The angle A2 may correspond to a field of view of 15.9 m (e.g., horizontally) at a distance of 100 meters from the weapon sight 400. The user of the weapon sight 400 may position their eye 450 off center (e.g., horizontally). The user may be able to see through the weapon sight 400 up to an angle A3 (e.g., measured horizontally) from the center of the weapon sight 400. Stated differently, the user's view through the weapon sight may be obscured at the angle A3 from the center of the weapon sight 400. The angle A3 may be approximately 40.9 degrees.

Figure 19:
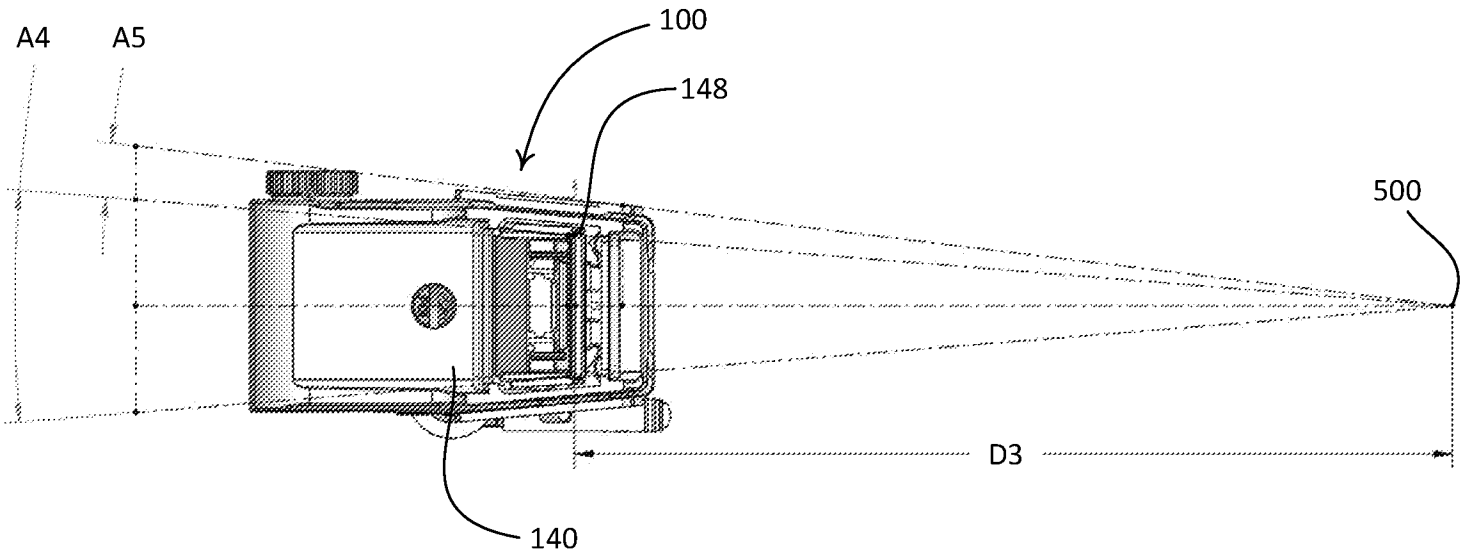
FIG. 19 is a diagram of the horizontal obscurance and horizontal field of view of the example weapon sight shown in FIG. 1.

FIG. 19 depicts an example horizontal field of view and an example horizontal obscurance of the weapon sight 100. The housing 140 may be tapered at an angle. A user of the weapon sight 100 may position their eye 500 a certain distance from the rear window 148. When a user's eye 500 is a distance D3 from the rear window 148, the horizontal field of view may be defined by an angle A4. The angle A4 may be determined based on a weapon type and a weapon use case. The angle A4 may be determined based on the angle A4 and the distance D3. The distance D3 may be approximately 15 cm. The angle A4 may be approximately 9.1 degrees, for example, when the user's eye 500 is aligned (e.g., horizontally) with the center of the weapon sight 100. The angle A4 may correspond to a horizontal field of view of 15.9 m (e.g., horizontally) at a distance of 100 meters from the weapon sight 100. A horizontal downfield view of the user may be obscured by the housing 140 and the hood 150 of the weapon sight 100. For example, an angle A5 may represent the horizontal area that is obscured by the housing 140 and the hood 150 of the weapon sight 100 when the user's eye 500 is positioned at the center (e.g., horizontally) of the weapon sight 100. The angle A5 may be approximately 2.3 degrees.

Figure 20:
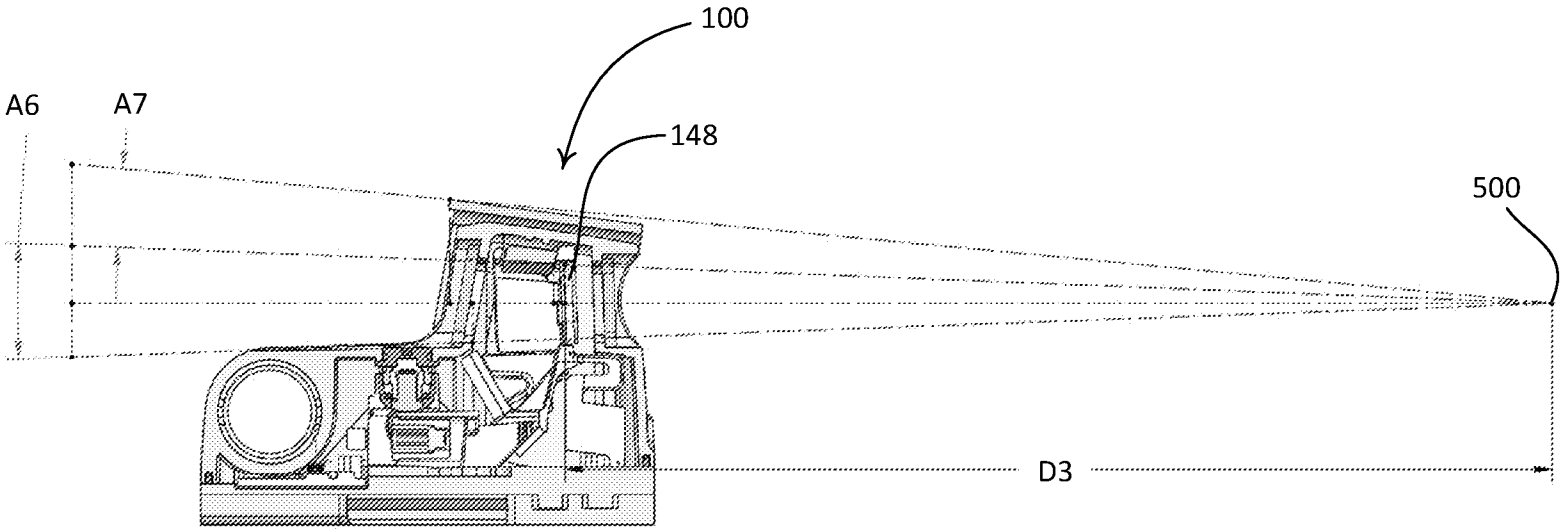
FIG. 20 is a diagram of the vertical obscurance and vertical field of view of the example weapon sight shown in FIG. 1.

FIG. 20 depicts an example vertical field of view and an example vertical obscurance of the weapon sight 100. A user of the weapon sight 100 may position their eye 500 a certain distance from the rear window 148. When a user's eye 500 is a distance D3 from the rear window 148, the vertical field of view may be defined by an angle A6. The distance D3 may be approximately 15 cm. The angle A6 may be approximately 4.3 degrees, for example, when the user's eye 500 is aligned (e.g., vertically) with the center of the weapon sight 100. The angle A6 may correspond to a vertical field of view of 7.5 m (e.g., vertically) at a distance of 100 meters from the weapon sight 100. A vertical downfield view of the user may be obscured by the housing 140 and the hood 150 of the weapon sight 100. For example, an angle A7 may represent the vertical area that is obscured by the housing 140 and the hood 150 of the weapon sight 100 when the user's eye 500 is positioned at the center (e.g., vertically) of the weapon sight 100. The angle A7 may be approximately 3.14 degrees.

Figure 21:
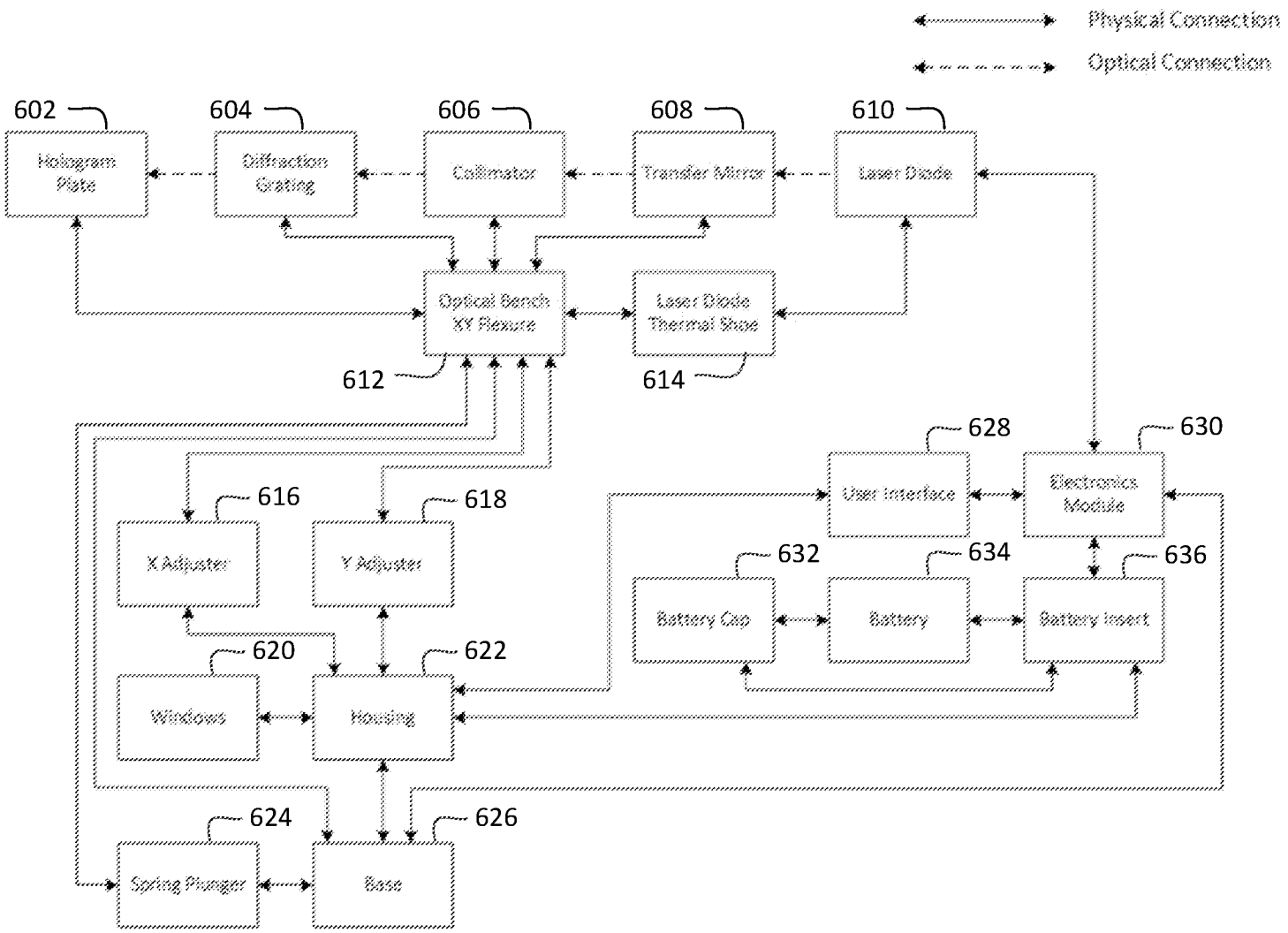
FIG. 21 is a block diagram of an example weapon sight showing the physical connections and optical connections.

FIG. 21 is a functional block diagram of an example modular weapon sight 600 (e.g., such as the weapon sight 100 shown in FIGS. 1-11B showing the physical connections and optical connections between the components of the weapon sight 600. The weapon sight 600 may be configured to minimize the physical connections between the components of the weapon sight 600. A hologram plate 602 may be physically connected to (e.g., only) an optical bench 612. A diffraction grating 604 may be physically connected to (e.g., only) the optical bench 612. The hologram plate 602 may be optically connected to (e.g., only) the diffraction grating 604. The diffraction grating 604 may be optically connected to the hologram plate 602 and a collimator 606. The collimator 606 may be physically connected to (e.g., only) the optical bench 612. The collimator 606 may be optically connected to the diffraction grating 604 and a transfer mirror 608. The transfer mirror 608 may be physically connected to (e.g., only) the optical bench 612. The transfer mirror 608 may be optically connected to the collimator 606 and a laser diode 610. The laser diode 610 may be physically connected to a laser diode shoe 614 and an electronics module. The laser diode 610 may be optically connected to the transfer mirror 608. The laser diode shoe 614 may be physically connected to (e.g., only) the optical bench 612.

A horizontal adjuster 616 may be physically connected to the optical bench 612 and a housing 622. A vertical adjuster 618 may be physically connected to the optical bench 612 and the housing 622. One or more windows 620 may be physically connected to (e.g., only) the optical bench 612. A spring plunger 624 may be physically connected to the optical bench 612 and/or a base 626. The housing 622 may be physically connected to the base 626.

The electronics module 630 may be physically connected to the base 626, a user interface 628, and a battery insert 636. The user interface 628 may be physically connected to the housing 622. Although FIG. 21 shows the user interface 628 connected to the housing 622, it should be appreciated that the user interface 628 may be physically connected to the base 626 (e.g., instead of the housing 622). The battery insert 636 may be physically connected to a battery 634 and the electronics module 630. The battery 634 may be physically connected to the battery insert 636 and a battery cap 632. The battery cap 632 may be physically connected to the battery 634 and the battery insert 636.

The terms used herein should be seen to be terms of description rather than of limitation. It is understood that those of skill in the art with this disclosure may devise alternatives, modifications, or variations of the principles of the invention. It is intended that all such alternatives, modifications, or variations be considered as within the spirit and scope of this invention, as defined by the following claims.

What is claimed is:

1. A weapon sight comprising:
a rear window;
a front window; and
a housing having a first segment and a second segment extending from the rear window to the front window and on opposed sides of an optical path;
wherein a first line extends along a first surface of the first segment and a second line extends along a second surface of the second segment, the first line and the second line being straight, extending from the rear window to the front window on the opposed sides of the optical path, and following a field of view of a user based on a predetermined distance between an eye of the user and the rear window;
wherein the first line and the second line extend from a rear edge to a front edge of the housing; and
wherein the first segment and the second segment are planar.

2. The weapon sight according to claim 1, further comprising a hood that surrounds at least a portion of the housing, wherein the hood includes a third segment and a fourth segment having surfaces that are intersected by a plane in a third line and a fourth line, respectively, on the opposed sides of the optical path;
wherein the third line and the fourth line are straight and extend from a rear edge to a front edge of the hood; and
wherein the plane extends through the rear window and the front window and intersects the first segment at the first line and the second segment at the second line.

3. The weapon sight according to claim 1, wherein a plane extending through the rear window and the front window intersects the first segment at the first line and the second segment at the second line.

4. The weapon sight according to claim 3, wherein the weapon sight includes a base that is configured to mount to a weapon, and the plane is horizontal when the base is below the optical path.

5. The weapon sight according to claim 1, wherein the first segment and the second segment are planar.

6. The weapon sight according to claim 1, further comprising a hood that surrounds at least a portion of the housing that includes the first segment and the second segment;
wherein a plane extending through the rear window and the front window intersects the first segment at the first line and the second segment at the second line; and
wherein the hood includes a third segment and a fourth segment having surfaces that are intersected by the plane in a third line and a fourth line, respectively, on the opposed sides of the optical path.

7. The weapon sight according to claim 6, wherein additional lines extend from a rear edge to a front edge of the hood.

8. A weapon sight comprising:
a housing defining a rear opening and a front opening through which an optical path extends, the housing having a first segment and a second segment on opposite sides of the optical path;
wherein a plane extending through the rear opening and the front opening intersects a first surface of the first segment in a first intersection and a second surface of the second segment in a second intersection, the first intersection and the second intersection spreading further apart over an entire distance from the rear opening to the front opening.

9. The weapon sight according to claim 8, further comprising a rear window coupled to the housing adjacent the rear opening and a front window coupled to the housing adjacent the front opening;
wherein the first intersection and the second intersection are straight lines; and
wherein the weapon sight includes a base that is configured to mount to a weapon, and the plane is horizontal when the base is below the optical path.

10. The weapon sight according to claim 8, further comprising a rear window coupled to the housing adjacent the rear opening and a front window coupled to the housing adjacent the front opening.

11. The weapon sight according to claim 8, wherein the first intersection and the second intersection are straight lines.

12. The weapon sight according to claim 11, wherein the first segment and the second segment are planar.

13. The weapon sight according to claim 8, wherein the weapon sight includes a base that is configured to mount to a weapon, and the plane is horizontal when the base is below the optical path.

14. A hood for a weapon sight, the weapon sight including a rear window, a front window, and a housing having a first segment and a second segment extending from the rear window to the front window and on opposed sides of an optical path,
wherein a first line extends along a first surface of the first and a second line extends along a second surface of the second segment, the first line and the second line being straight, extending from the rear window to the front window on the opposed sides of the optical path, and following a field of view of a user based on a predetermined distance between an eye of the user and the rear window,
wherein the first line and the second line extend from a rear edge to a front edge of the housing, and
wherein a plane extending through the rear window and the front window intersects the first segment at the first line and the second segment at the second line, the hood comprising:

a third segment and a fourth segment on opposed sides of the optical path;

wherein the hood surrounds at least a portion of the housing, and the plane extends through the optical path and intersects the third segment and the fourth segment in third and fourth lines on the opposed sides of the optical path, the third and fourth lines following the field of view of the user.

15. The hood according to claim 14, wherein the third and fourth lines extend from a rear edge to a front edge of the hood.

16. The hood according to claim 15, wherein the third segment and the fourth segment are planar.

17. The hood according to claim 14, wherein the third segment and the fourth segment are planar.

18. The hood according to claim 14, wherein the hood, when coupled to the weapon sight, extends below the optical path.

* * * * *